US006592001B2

(12) United States Patent
Lewis et al.

(10) Patent No.: US 6,592,001 B2
(45) Date of Patent: Jul. 15, 2003

(54) DISPENSER FOR SHEET MATERIAL CONTAINING A DISPENSING PORT INCREMENTALLY VARIABLE WITHIN A RANGE

(75) Inventors: Richard Paul Lewis, Marietta, GA (US); Cleary Efton Mahaffey, Suwanee, GA (US); Paul Francis Tramontina, Alpharetta, GA (US)

(73) Assignee: Kimberly-Clark Worldwide, Neenah, WI (US)

( * ) Notice: Subject to any disclaimer, the term of this patent is extended or adjusted under 35 U.S.C. 154(b) by 36 days.

(21) Appl. No.: 10/022,473

(22) Filed: Dec. 18, 2001

(65) Prior Publication Data

US 2003/0111480 A1 Jun. 19, 2003

(51) Int. Cl.[7] ..... B65H 1/00

(52) U.S. Cl. ..... 221/33; 221/45; 221/63; 221/304

(58) Field of Search ..... 221/33, 44, 45, 221/61, 63, 304

(56) References Cited

U.S. PATENT DOCUMENTS

| | | | | |
|---|---|---|---|---|
| 2,780,388 A | | 2/1957 | Stephenson | |
| 2,858,045 A | | 10/1958 | Loeb | |
| 4,463,912 A | | 8/1984 | Grunerud | |
| 4,648,530 A | | 3/1987 | Granger | |
| 4,905,868 A | | 3/1990 | Beane et al. | |
| 5,135,136 A | * | 8/1992 | Moone | 221/304 |
| 5,246,137 A | | 9/1993 | Schutz et al. | |
| 5,370,338 A | | 12/1994 | Lewis | |
| 5,715,971 A | * | 2/1998 | Morand | 221/45 |
| 5,749,492 A | | 5/1998 | Petterson | |
| 5,857,642 A | | 1/1999 | Zinnbauer | |
| 5,950,863 A | | 9/1999 | Schutz et al. | |
| 6,145,782 A | | 11/2000 | King et al. | |
| 6,510,964 B2 | * | 1/2003 | Paukov et al. | 221/33 |

FOREIGN PATENT DOCUMENTS

| | | | |
|---|---|---|---|
| EP | 0595779 B1 | | 5/1994 |
| JP | 6-121754 A | * | 5/1994 |

OTHER PUBLICATIONS

PCT International Search Report, Dec. 13, 2002, for International Application No. PCT/US 02/31694.

* cited by examiner

*Primary Examiner*—David H. Bollinger
(74) *Attorney, Agent, or Firm*—Sue C. Watson

(57) ABSTRACT

A dispenser adapted to dispense sheet material therefrom is provided and includes a housing configured to support a sheet material product therein which has an exit port. The dispenser also includes at least an iris diaphragm for controlling the movement of sheet material from the housing through the exit port.

48 Claims, 10 Drawing Sheets

DISPENSER FOR SHEET MATERIAL CONTAINING A DISPENSING PORT INCREMENTALLY VARIABLE WITHIN A RANGE

FIELD OF THE INVENTION

The invention generally relates to dispensers, and more specifically, to dispensers for dispensing sheet material having an adjustable dispensing port.

BACKGROUND

Dispensers for rolls or stacks of sheet material have an exit port which usually permits one sheet material at a time to be dispensed therethrough. Problems exist when an exit port has only a single diameter through which a sheet material is dispensed to a user. This results in too many sheets or too few sheets dispensed through the exit port, depending upon the diameter of the exit port and the characteristics of the sheet material. Therefore, dispensers have been provided which include various apparatus for addressing the problem.

One dispenser, U.S. Pat. No. 5,370,338 to Lewis, which is hereby incorporated by reference herein, discloses a variable orifice centerflow dispenser that provides a movable disk over an exit port which has several different sizes of orifices formed in the disk. A specific orifice in the disk is selected by an operator when a roll of sheet material is positioned in the dispenser. The limited selection of orifice diameters, however, has disadvantages as well. Another dispenser, U.S. Pat. No. 5,749,492 to Petterson, which is hereby incorporated by reference herein, discloses a sheet dispenser which uses two arcuately-shaped plates which are brought together to provide an adjustable opening over an exit port. This type of dispenser also has disadvantages.

When an apparatus positioned over an exit port has an opening having a diameter that is too large, an excessive, wasteful number of sheets may be dispensed to a user. When such an apparatus has an opening having a diameter that is too small, a sheet may tear off inside of the dispenser without a leading edge extending through the opening and the exit port, making the remaining sheets in the roll unavailable to a user. In addition, when an apparatus has an elliptically-shaped opening through which sheets are dispensed, the sheets may become caught or tear off in the apparatus due to snagging of the sheet material within the narrowing at each end of the elliptically-shaped opening while being pulled through the opening by a user.

Additional problems are also created because sheet material products from various manufacturers may be used in the dispenser, and each product has its own characteristics. That is, the caliper and basis weight of the sheet material of each product will likely be different. Further, the machine direction tensile of the sheet material will vary in different products. Moreover, the tab strength of each sheet material will also vary product-to-product. These differing characteristics of each product require an operator to adjust the diameter of an opening in an apparatus adjacent the exit port for each particular product contained therein. When the choice of diameter of the opening of the apparatus is limited to only a few choices of an opening diameter, or when generally elliptically-shaped openings are provided, it can result in either waste by dispensing too many sheets to a user, or lack of use and user aggravation when sheet material tears off inside of the dispenser and is not dispensed through an apparatus opening and the exit port. Further, when sheets snag or tear apart when pulled through an apparatus having an elliptically-shaped opening, waste and/or user aggravation is again the result.

In addition, when an operator has adjusted an apparatus in a dispenser to properly dispense a sheet material through the exit port, it can be difficult for the operator to push the sheet material through an opening having a small diameter in such an apparatus. Therefore, reloading of sheet material provides difficulties for an operator each time new sheet material is disposed in the dispenser.

It would be advantageous to have a dispenser for sheet material which is rolled, or sheet material which is stacked, which permits an operator to choose from any one of a large number of diameters of an opening formed by an apparatus positioned near or over the exit port. Such an apparatus would provide an opening whose diameter is incrementally increased or decreased, within a range, to accommodate the characteristics of different sheet material products. Such a dispenser would permit the operator to quickly and easily optimize the diameter of the apparatus opening to the characteristics of a specific product contained therein so that sufficient sheets are dispensed to a user, and neither waste nor user aggravation occurs. In addition, the apparatus would form an opening configured to reduce or eliminate snagging, tearing, or ripping of sheet material when it moves through the apparatus opening and exit port.

Ease in loading new sheet material without having to re-adjust a diameter of an opening of an apparatus for the same product would also be advantageous. Therefore, the dispenser would also include additional components which cooperate with the apparatus to quickly and easily increase the diameter of the opening of the apparatus to allow an operator to easily load sheet material and dispose a leading edge of a sheet through the apparatus opening and exit port. Yet, such an apparatus and additional components would decrease the diameter of the opening to its pre-adjusted diameter for dispensing just as quickly and easily, once sheet material was disposed therein, to provide proper dispensing of the newly loaded sheet material through the apparatus opening and exit port.

DEFINITIONS

As used herein, the term "caliper" refers to the thickness measurement of a sheet taken under constant force. The caliper may be determined using test method number TAPP 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" is the opening in a housing of a dispenser for the passage of sheet material.

As used herein, the term "iris diaphragm" means three or more iris blades supported for movement by a cam gear which cooperate to forming an iris diaphragm which forms an opening having a diameter that is incrementally adjustable within a range of movement of the iris blades so that when the iris blades are moved incrementally and simultaneously toward each other, the diameter of the opening of the iris diaphragm is decreased; when the iris blades are moved incrementally and simultaneously away from each other, the diameter of the opening of the iris diaphragm is increased. In this manner, the iris diaphragm is capable of providing any one of a great number of diameters of the opening therein within the range. The iris diaphragm forms a near closure, that is, a smaller opening at a low end of the range, and, at the high end of the range, forms an opening having an increased diameter sized generally at least about the diameter of the exit port.

As used herein, the term "centerflow roll" or "centerflow roll product" means sheet material wound cylindrically about a center, but permitting the removal of material from the center. Desirably, as the centerflow roll is consumed, sheet material eventually dispenses from the roll's periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the terms "incrementally", "incremental", and/or "increment(s)" mean a change in measurement, i.e., an increase or decrease in the diameter of an opening formed by the iris diaphragm in a range of about 0.5 millimeters (hereinafter "mm" or "mms") in one increment to at least about the diameter of the exit port, for example, in the present embodiment, about 8.0 centimeters (hereinafter "cm" or "cms") in one increment. For example, the diameter of the opening of the iris diaphragm to dispense a two ply paper towel or wiper is about 1.3 cms to about 1.7 cms. A diameter within the range, i.e., 1.5 cms, may be obtained by using one increment of 1.5 cms, or, alternatively, a number of equal and/or unequal increments that reached the desired diameter of 1.5 cms. The measurement of either end of the range for the increments is limited only by the limitation of size and movement of the iris blades relative to their operation in the iris diaphragm.

As user herein, the term "couple" includes, but is not limited to, joining, connecting, fastening, linking, or associating two things integrally or interstitially together.

SUMMARY OF THE INVENTION

In one aspect of the invention, a dispenser adapted to dispense sheet material is provided, and includes a housing. The housing includes at least an exit port and is configured to support sheet material therein. An iris diaphragm including at least three iris blades is positioned on the housing. The iris diaphragm is supported for movement to form an opening having a diameter incrementally adjustable within a range. The iris diaphragm is configured to be adjusted to any one of a plurality of opening diameters within the range. The iris diaphragm is also configured to permit the diameter of the opening to be adjusted for each product-type of sheet material positioned in the dispenser to provide controlled dispensing of the sheet material from the dispenser.

In another aspect of the invention, an apparatus adapted for use with a dispenser housing for sheet material is provided. The apparatus is configured to cooperate with an opening formed in the dispenser housing to control the flow of sheet material disposed in the dispenser housing and extending through the opening therein. The apparatus includes a platform formed to include an exit port, and an iris diaphragm. The iris diaphragm includes a plurality of iris blades positioned on the platform and supported for movement to form an opening having a diameter incrementally adjustable within a range. The iris diaphragm is configured to be adjusted to any one of a plurality of opening diameters within the range. In addition, the iris diaphragm is configured to permit the diameter of the opening formed therein to be adjusted for each product-type of sheet material positioned in a dispenser housing to provide controlled dispensing of the sheet material from the apparatus and through the exit port.

A method of installing a sheet material product into a dispenser is provided. A platform provided in a housing of a dispenser having an exit port is accessed. A portion of a slide assembly positioned in the dispenser is moved at least partially away from the dispenser. The slide assembly is operatively engaged to at least a portion of an iris diaphragm which is supported by a portion of the housing, and the movement of the slide assembly causes movement of the iris diaphragm such that a diameter of an opening formed by the iris diaphragm is increased to provide a loading position adjacent the exit port. A sheet material product is disposed onto the platform. The platform is formed to include an opening positioned at least partially below the product, and the opening is in communication with the opening formed by the iris diaphragm and the exit port forming a channel for the movement of sheet material therethrough. A leading edge of the sheet material is pushed through the channel and the exit port. The portion of the slide assembly is moved toward the dispenser, the slide assembly causing movement of the iris diaphragm such that the diameter of the opening formed thereby is moved to its pre-adjusted diameter providing a dispensing position.

In another aspect of the invention another method of installing sheet material into a dispenser is provided. A dispenser housing configured to support sheet material therein and having an iris diaphragm and an exit port is provided. The diameter of an opening in the iris diaphragm is incrementally adjusted such that the opening is sized to permit an effective number of sheet materials to be dispensed through the opening and the exit port such that the sheet material neither excessively dispensed nor under dispensed.

In yet another aspect of the invention, a dispenser adapted to dispense sheet material is provided. The dispenser comprises a housing including a platform having an exit port therein and configured to support sheet material therein. The dispenser also includes at least an iris diaphragm for controlling the movement of sheet material disposed in the housing through the exit port.

These and various other advantages of the invention are provided throughout the present disclosure. However, for a better understanding of the invention, reference should be made to the drawings which form a further part hereof, and to the accompanying detailed description.

DETAILED DESCRIPTION

Figure 1:
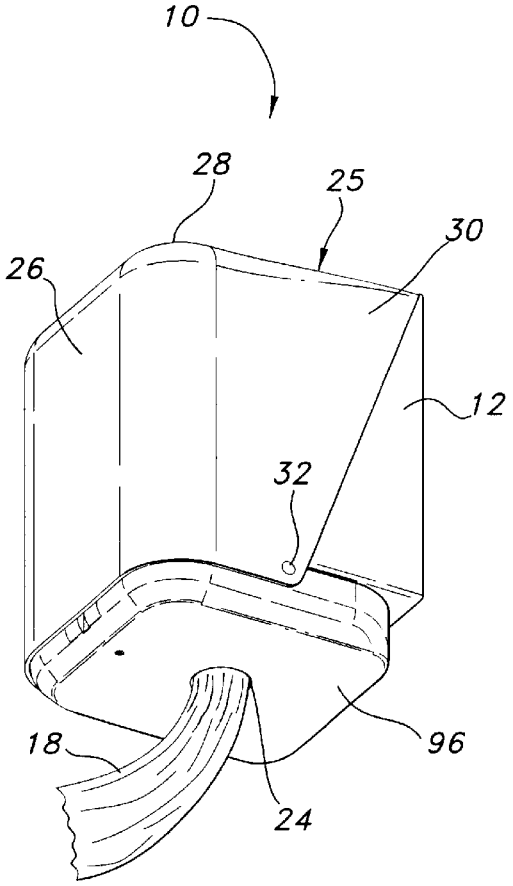
FIG. 1 is a perspective view of a dispenser for sheet material having a dispensing port incrementally variable within a range.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Illustrated in FIGS. 1–4 is a dispenser 10 for sheet material containing a dispensing port incrementally variable within a range. The dispenser 10 includes a mounting plate 12 configured to permit attachment of the dispenser 10 to a wall (not shown) and a roll platform 14 configured to have an opening 16 therein to permit sheet material 18 from a centerflow roll 20 disposed on the roll platform 14 to move therethrough. The dispenser 10 includes a dispensing platform 22 positioned adjacent the roll plafform 14. The dispensing platform 22 includes an exit port 24 axially aligned with the opening 16 in the roll platform 14, to facilitate movement of sheet material 18 therethrough to a user. A cover 25 having a front 26, a top 28, and opposite sidewalls 30 is coupled to the dispensing platform 22 via a pair of pins 32. Each pin 32 is positioned through an aperture 33 formed on each side 30 of the cover 25 and through each slot 34 formed on each sidewall 36, 37 of the dispensing platform 22. It will be understood, however, that hinges or other fasteners (not shown) may be used, or the cover 25 may instead be coupled to the mounting plate 12 in addition to, or instead of, the dispensing platform 22 (not shown). The cover 25 may be formed from an opaque material, or alternatively, the cover 25, or any portion thereof, may be formed from a clear, tinted, or translucent material, so that a reduction in the centerflow roll 20 disposed in the dispenser 10 can be seen by an operator.

Figure 2:
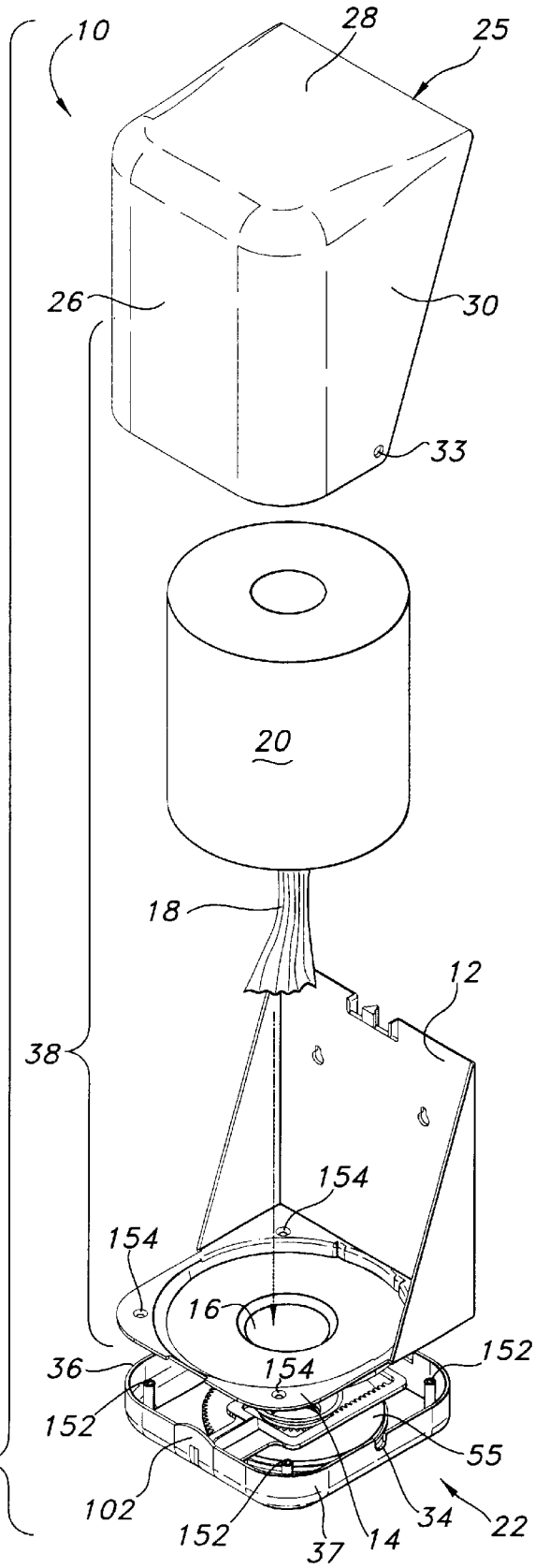
FIG. 2 is an exploded perspective view of the dispenser of FIG. 1.

The mounting plate 12, the roll platform 14, the dispensing platform 22, and the cover 25 cooperate to form a housing 38 which is configured to hold sheet material, and in this embodiment, to hold at least one centerflow roll 20 of sheet material 18. The dispensing platform 22 may also be provided as a separate unit, to attach to an existing housing. As illustrated in FIG. 2, the cover 25 is removed so that the centerflow roll 20 of sheet material 18 is disposed on the roll platform 14 of the dispenser 10. The dispensing platform 22 includes a dispensing port or iris diaphragm 40 (FIG. 12) which provides a near closure as well as an opening 42 in axial alignment with both the opening 16 in the roll platform 14 and the exit port 24. The iris diaphragm 40, described in detail below, is adjustable so that the diameter of the opening 42 is incrementally adjustable within a range, thereby controlling the amount of sheet material 18 flowing from the dispenser 10 through the exit port 24.

Turning now to the dispensing platform 22, illustrated in FIGS. 2–8, the dispensing platform 22 includes a base 43 having an outer perimeter 44. Opposite sidewalls 36, 37, as well as rear and front walls 45, 46 extend upwardly from the outer perimeter 44. Three spaced-apart pairs of iris blade guide ribs 47, 48, 49 are positioned around the exit port 24. Each pair of guide ribs 47, 48, 49 is configured to hold one iris blade. Iris blades 52, 53, 54 are positioned between guide ribs 47, 48, 49, respectively, and supported for movement so that iris blades 52, 53, 54 are movable when operably coupled to a cam gear 55 (FIGS. 9–12) to form the iris diaphragm 40 (FIG. 12) and thereby cooperate to provide both the opening 42 whose diameter is incrementally adjustable within a range and a near closure over the exit port 24, as will be described in further detail below. It will be understood that any number of pairs of support ribs and accompanying iris blades may be provided.

A circular cam gear support rib 56 (FIGS. 5, 7, and 8) is positioned on the base 43 to extend circularly around the exit port 24 and the guide ribs 47, 48, 49. The cam gear 55, as illustrated in FIGS. 9–12, lies within the support rib 56 and is formed to include a central aperture 59 which is an axial alignment with the exit port 24 and openings 16 and 42, respectively, of the roll platform 14 and the iris diaphragm 40 as well, and which has a diameter at least equal to the diameter of the exit port 24. Each iris blade 52, 53, 54 is movably engaged to the cam gear 55.

Each iris blade 52, 53, 54, as illustrated in FIGS. 4, 7, 8, 12, and FIGS. 13A–13D, includes a central base portion 60 having at one end in the present embodiment, but not by way of limitation, a concave edge 62 and at and opposite end a stem portion 64. The concave edge 62 of each base portion 60 is positioned adjacent the exit port 24, while the stem portion 64 is positioned adjacent the cam gear support rib 56. Each stem portion 64 includes, on an upper surface 65, a boss or cam follower 66 which extends upwardly to engage one of three cam recesses 68 formed in a lower surface 70 of the cam gear 55. The combination of the cam recesses 68 of the cam gear 55 and the iris blade guide ribs 47, 48, 49 define a range and its extent for movement of the cam followers 66 and each iris blade 52, 53, 54, respectively, and therefore assists in defining the range of all possible diameters of the opening 42 of the iris diaphragm 40.

The cam gear 55 is rotated on an axis 72, which is the axis for the iris diaphragm 40, and which, in the present embodiment, but not by way of limitation, is in axial alignment with the opening 16 of the roll platform 12, the aperture 59 of the cam gear 55, the opening 42 formed by the iris blades 52, 53, 54 of the iris diaphragm 40, and the exit port 24. Rotation of the cam gear 55 creates movement of the iris blades 52, 53, 54 via the cam followers 66 coupled to their respective cam recesses 68 of the cam gear 55. That is, the concave edge 62 of each iris blade 52, 53, 54 is moved towards the axis 72 to incrementally form a decreased or smaller diameter of the opening 42 of the iris diaphragm 40 within the range. Alternatively, when the cam gear 55 is rotated an opposite direction, the concave edge 62 of each iris blade 52, 53, 54 is moved away from the axis 72 to incrementally form an increased or larger diameter of the opening 42 of the iris diaphragm within the range. Therefore, movement of the iris blades 52, 53, 54 by the cam gear 55 results in a large number of possible diameters for the opening 42 of the iris diaphragm 40, as shown in FIGS. 4, 7, 8, 11, and 12. The iris diaphragm 40 permits the diameter of the opening 42 to be incrementally increased or incrementally decreased in a range of about 0.5 mm up to and including the diameter of the exit port 24 in the present embodiment, but not by way of limitation, about 8.0 cms. That is, one increment may be as small as 0.5 mm, while another increment may be much larger, such as, for example, 8.0 cms. Often, the increment size used by an operator may range from between about 1.0 cm and about 8.0 cms. Frequently, the increment size may be between about 0.2 cm and about 3.0 cms. In some instances, the increment size may be between about 0.5 cm and about 2.0 cms. In other instances, the increment size may be between about 0.5 cm and about 1.0 cms. At other times, the increment size may be between about 0.5 cm and about 0.75 cm. It will be understood that the measurement of the largest increment, as well as the smallest increment, is based on the size of the exit port 24, the size(s) of the iris blades 52, 53, 54, and the range of movement of the iris blades 52, 53, 54 via the cam gear 55, and the like.

A desired diameter of the opening 42 of the iris diaphragm 40 to dispense a one ply paper towel product, or thin wiper, may be in a range from about 1.1 cms to about 1.35 cms. A desired diameter within the range may be reached by using one increment of 1.2 cms, or, alternatively, any number of equal and/or unequal increments that provide a diameter within the desired range. In further examples, but not by way of limitation, a desired diameter of the opening 42 to dispense a two ply towel or wiper may be from about 1.3 cms to about 1.7 cms. Another diameter of the opening 42 to dispense a thicker multiply towel or wiper may be from about 2.0 cms to about 2.5 cms.

In addition, the measurement of the diameter of the opening 42 formed by the iris blades 52, 53, 54 will be more than 50% of the measured length of each portion of each iris blade 52, 53, 54 next to the opening 42, at any diameter of the opening 42. Further, the measurement of the diameter of the opening 42 formed by the iris blades 52, 53, 54 may be more than 60% of the measured length of each portion of each iris blade 52, 53, 54 next to the opening 42, at any diameter of the opening 42. Moreover, the measurement of the diameter of the opening 42 formed by the iris blades 52, 53, 54 may be more than 70% of the measured length of each portion of each iris blade 52, 53, 54 next to the opening 42, at any diameter of the opening 42. Yet further, the measurement of the diameter of the opening 42 formed by the iris blades 52, 53, 54 may be more than 80% of the measured length of each portion of each iris blade 52, 53, 54 next to the opening 42, at any diameter of the opening 42.

The cam gear 55, as illustrated in FIGS. 9–12, 18, and 20–21, includes a segment of cam gear teeth 74 positioned radially about a portion of the outer perimeter 76 of the cam gear 55. The cam gear 55 only requires partial rotation to fully open or to nearly close the iris diaphragm 40. The cam gear 55 also has a plurality of notches 78 (FIGS. 9 and 10) formed about an inner perimeter 80 defining the aperture 59 therein, whose function will be discussed in further detail below.

Turning back again to the dispensing platform, as illustrated in FIGS. 4–8, the front wall 46 is formed to include a slot 82. A pair of spaced-apart slide support ribs 84 are arranged adjacent the slot 82 and are positioned in alignment between the slot 82 and the circular cam gear support rib 56 to at least partially support a slide thereon, which will be described in detail below. An open adjustment gear mounting boss 86 is positioned near the slot 82 in the front wall 46, between the support ribs 84. An adjustment gear 87 is positioned in the mounting boss 86, and engages the cam gear 55 to provide an adjustment of the diameter of the opening 42 of the iris diaphragm 40 outside of the dispenser 10 by an operator.

Figure 12:
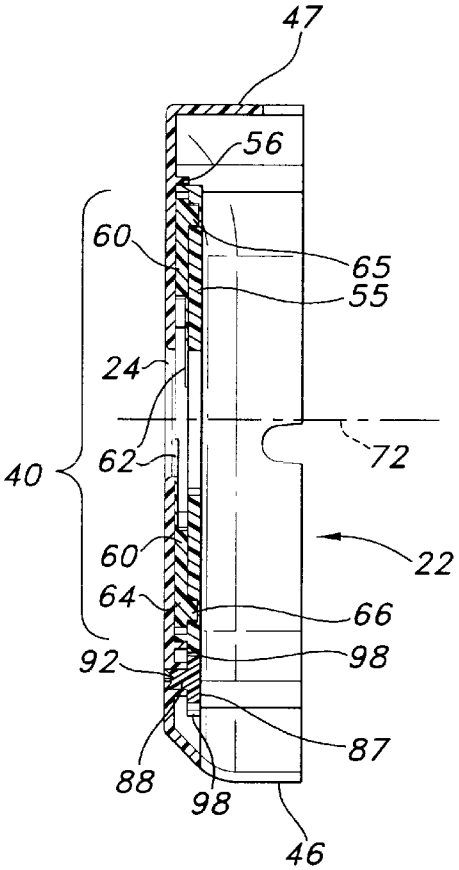
FIG. 12 is a cross sectional view of FIG. 11 taken along line 12—12, and showing the engagement of the cam gear to the iris blades and the adjustment gear thereby forming an iris diaphragm.
Figure 13D:
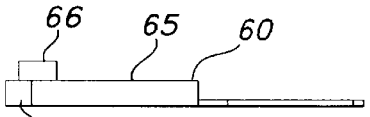
FIGS. 13A–D include a top plan view of an iris blade (13A) and three side elevational views of similar iris blades (13B–D), the present iris blade represented by FIG. 13B.
Figure 13C:
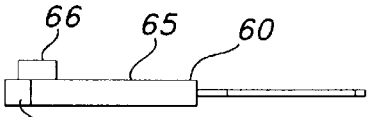
Figure 13B:
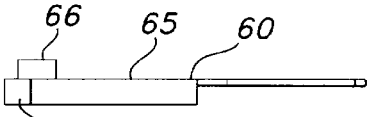
Figure 13A:
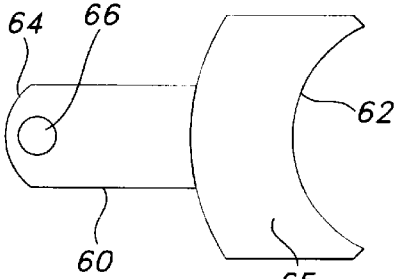
Figure 15C:
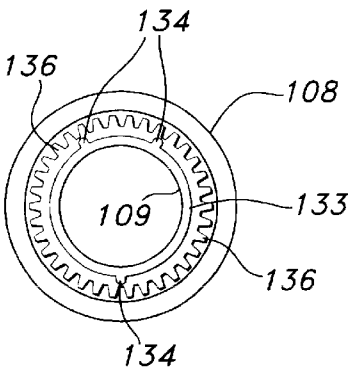
FIGS. 15A–C include a top plan view of an upper end of a pinion gear (15A), a cross sectional view of the pinion gear (15B), and a top plan view of a lower end of the pinion gear (15C)
Figure 15B:
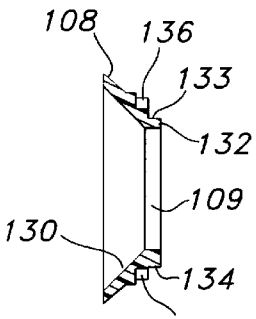
Figure 15A:
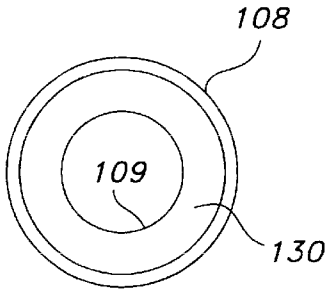
Figure 14A:
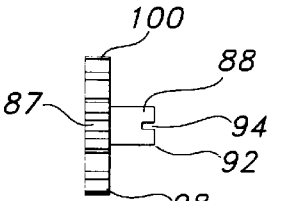
FIGS. 14A–B include a side elevational view of the adjustment gear (14A) and a top plan view of the lower end of the adjustment gear (14B)
Figure 14B:
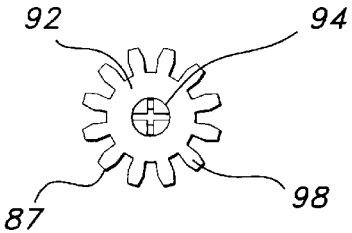

As shown in FIGS. 14A, 14B, and FIG. 12, the adjustment gear 87 includes a mounting shaft 88 which is formed on one end of the adjustment gear 87 and is positioned in the open adjustment gear mounting boss 86. The mounting shaft 86 has a lower end 92 which includes an adjustment slot 94. The lower end 92 and adjustment slot 94 are positioned to be slightly recessed adjacent and relative to a lower surface 96 of the dispensing platform 22 to provide access by an operator but not by a user. This recessed placement of the mounting shaft 88 prevents unwanted tampering of the adjustment gear 87 and therefore unwanted tampering or change of the diameter of the opening 42 of the iris diaphragm 40 by a user, while permitting relatively easy access by an operator to adjust the diameter of the opening 42 of the iris diaphragm 40.

Figure 11:
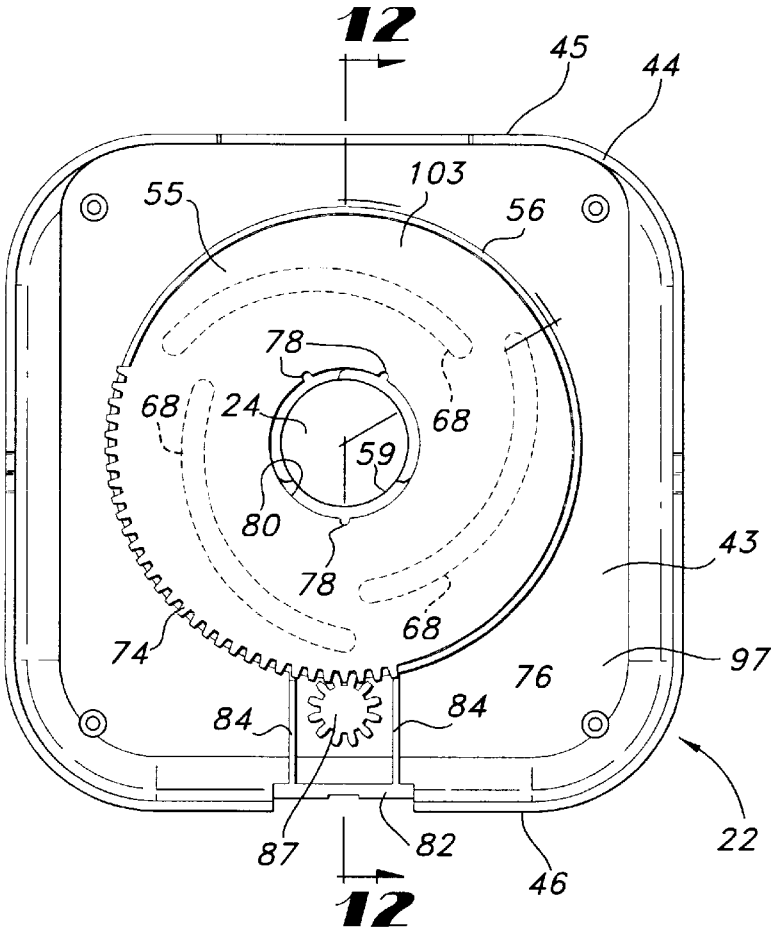
FIG. 11 is a top plan view of the dispensing platform, showing the cam gear, the position of the cam recesses (in phantom), and the cam gear's engagement with the adjustment gear.

The adjustment gear 87 is positioned opposite the lower end 92 of the mounting shaft 86, on the upper surface 97 of the dispensing platform 22. The adjustment gear 87 includes gear teeth 98 oriented radially about an outer perimeter 100 of the adjustment gear 87. The gear teeth 98 of the adjustment gear 87 are supported in the same plane as the gear teeth 74 of the cam gear 55, and engage the gear teeth 74 of the cam gear 55, as illustrated in FIGS. 11 and 12, to provide adjustment of the diameter of the opening 42 in the iris diaphragm 40, in accordance with the characteristics of the sheet material 18 of the centerflow roll 20 disposed therein.

To provide an adjustment of the diameter of the opening 42 of the iris diaphragm 40, an operator engages the adjustment slot 94 (FIGS. 14A and 14B) via an appropriate apparatus, such as, for example but not by way of limitation, a screw driver (not shown), to turn or rotate the adjustment gear 87 and therefore rotate the engaged cam gear 55 to incrementally adjust the diameter of the opening 42 of the iris diaphragm 40 to a diameter which is consistent with the characteristics of the sheet material 18 of the centerflow roll 20 disposed in the housing 38, so that sheet material 18 which extends from the dispenser 10 and through the exit port 24 is properly dispensed to a user. The limited movement of the cam followers 66 of each iris blade 52, 53, 54 in the cam recesses 68 of the cam gear 55 along with their limitation of movement as restricted by the guide ribs 47, 48, 49 prevents an operator from turning the adjustment gear 87 so as to cause disengagement of the gear teeth 74 of the cam gear 55 with the gear teeth 98 of the adjustment gear 87. It will be appreciated that the characteristics of each product-type of centerflow roll 20 of sheet material 18, that is, for example, but not by way of limitation, the caliper, the basis weight, the machine direction tensile, and the tab strength, are easily accommodated by the dispenser 10 and the iris diaphragm 40 contained therein, so that an operator can quickly and easily adjust the opening 42 of the iris diaphragm for these characteristics so that the particular sheet material is not overly wastefully dispensed, or tears off inside of the dispenser to be under dispensed, to provide controlled dispensing of the sheet material 18 from the dispenser 10. A controlling means may include the iris diaphragm 40, and may further include the adjustment gear 87 as well.

Once the diameter of the opening 42 of the iris diaphragm 40 is adjusted to a specific diameter within the range for a particular sheet material 18, it is undesirable and unpractical to have an operator re-set the diameter of the opening 42 every time a new centerflow roll 20 of the same product-type is disposed in the housing 38 of the dispenser 10. Therefore, a slide 102 and additional apparatus, as illustrated in FIGS. 15–21, is provided which permits an operator to increase the diameter of the opening of the iris diaphragm 40, often to about its largest diameter within the range, to provide a loading position to allow sheet material 18 from the new centerflow roll 20 to be easily loaded and positioned through the opening 42 of the iris diaphragm 40 and the exit port 24. The slide 102 and associated apparatus is configured to return the diameter of the opening 42 to its pre-adjusted position when the slide 102 is returned to its locked position.

The slide 102 is positioned to extend through the slot 82 in the front wall 46 of the dispensing platform 22, and over the slide support ribs 84, the adjustment gear 87, and an upper surface 103 of the cam gear 55, as shown in FIGS. 16–21. The slide 102 includes a rib 104 on an upper surface 106 thereof used to maintain the position of the slide 102 relative to the roll platform 14. The slide 102 is supported for movement and a pinion gear 108 is positioned through a portion of the slide 102 and engages the slide 102 when at least a portion of the slide 102 is moved away from the dispenser 10. The pinion gear 108 is also engaged to the cam gear 55, as will be described in further detail below.

Figure 19A:
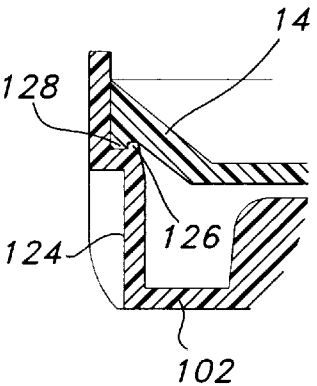
FIGS. 19A–B includes a cross sectional view of the locking tab of the slide coupled to the retention lip of the roll platform (19A) and the movement downward by an operator to unlock the locking tab of the slide from the retention lip, to permit movement of the slide (19B)

A rectangular portion 110 is formed in the slide 102 at one end and has a rectangular opening 114 therein. A gear rack 116 including rack gear teeth 118 is formed in a portion 120 of an inner perimeter 122 of the rectangular opening 114 of the slide 102. A handle 124 including a locking tab 126 is provided at an opposite end of the slide 102. The locking tab 126 engages a retention lip 128 formed in a front edge 130 of the roll platform 14, for holding the slide 102 in a locked position (FIGS. 19A and 19B).

The pinion gear 108, as illustrated in FIGS. 15A–15C and 16, 17, 20, and 21, is positioned through the rectangular opening 114 of the slide 102 to movably engage both the cam gear 55 and the slide 102. The pinion gear 108 includes an opening 109 having a diameter often as wide as the exit port 24, and often in axial alignment therewith. The pinion gear 108 includes a funnel-shaped member 130 supported by a shaft 132. A lower portion 133 of the shaft 132 has a plurality of radially-disposed protrusions 134 positioned thereabout. One of each of the plurality of protrusions 134 is configured to engage one of each of the notches 78 positioned in the inner perimeter 80 of the cam gear 55 to engage the pinion gear 108 to the cam gear 55. Pinion gear teeth 136 are positioned radially about an upper portion 138 of the shaft 132 and are parallel to the plurality of protrusions 134. The funnel-shaped member 130 extends above the upper portion 138 of the shaft 132 and extends outwardly to form a larger diameter than that of the rectangular opening 114 of the slide 102. The funnel-shaped member 130 is configured to funnel sheet material 18 from the centerflow roll 20 through the opening 16 in the roll platform 14 and the opening 109 of the pinion gear 108 and through the opening 42 of the iris diaphragm 40 and the exit port 24. A slide assembly includes both the slide 102 and the pinion gear 108.

Figure 16:
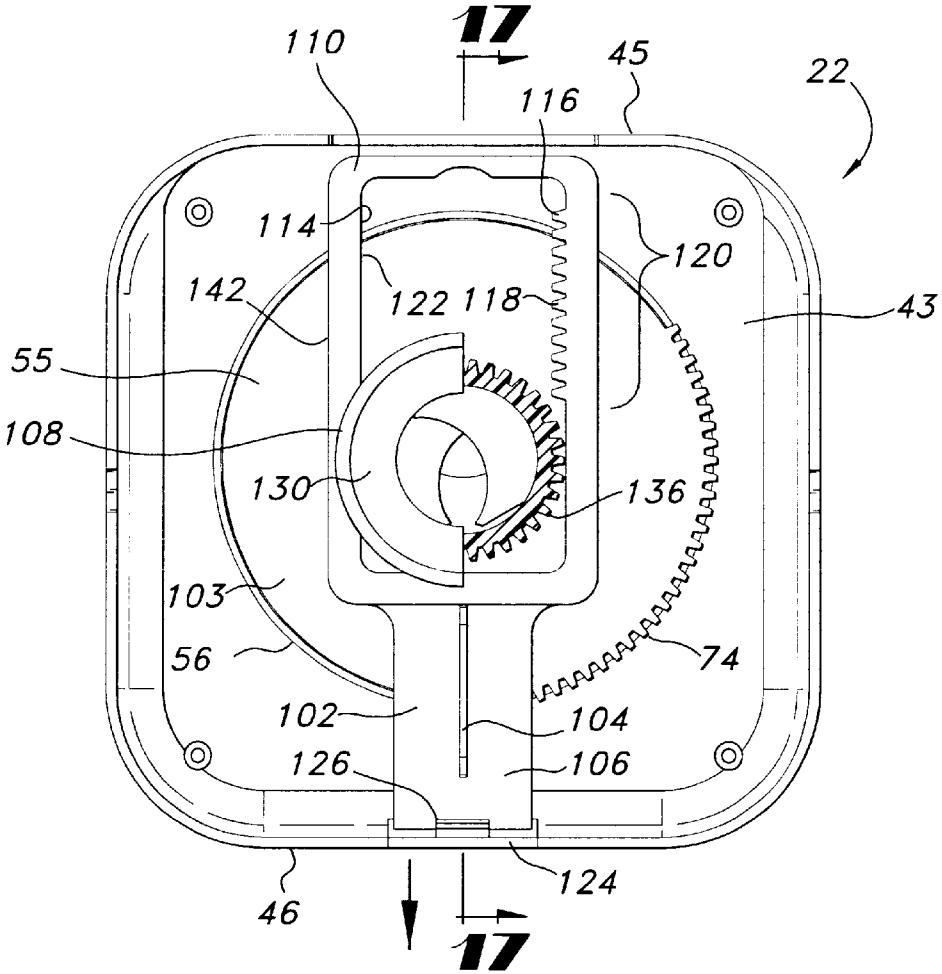
FIG. 16 is a top plan view of the dispensing platform and a partial sectional view of the pinion gear, showing the cam gear, the pinion gear, and the slide.
Figure 17:
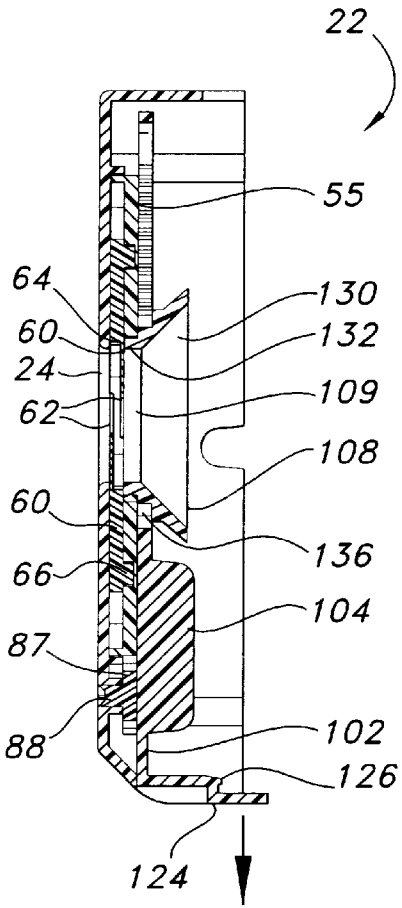
FIG. 17 is a cross sectional view of FIG. 16 taken along lines 17—17, showing the engagement of the cam gear to the iris blades and the adjustment gear, and showing the engagement of the pinion gear to both the cam gear and the slide.
Figure 19B:
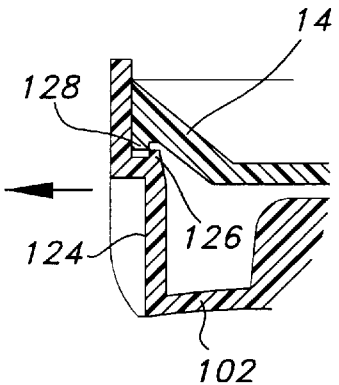
Figure 18:
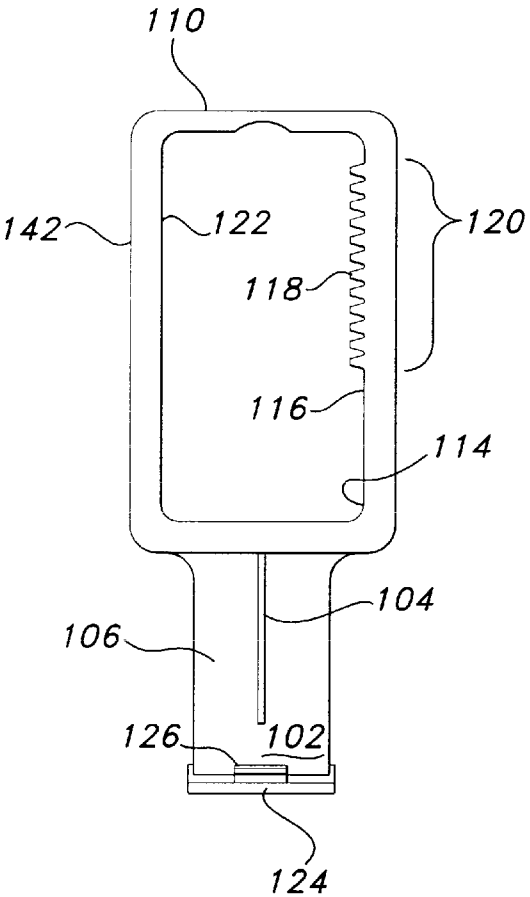
FIG. 18 is a top plan view of the slide.
Figure 21:
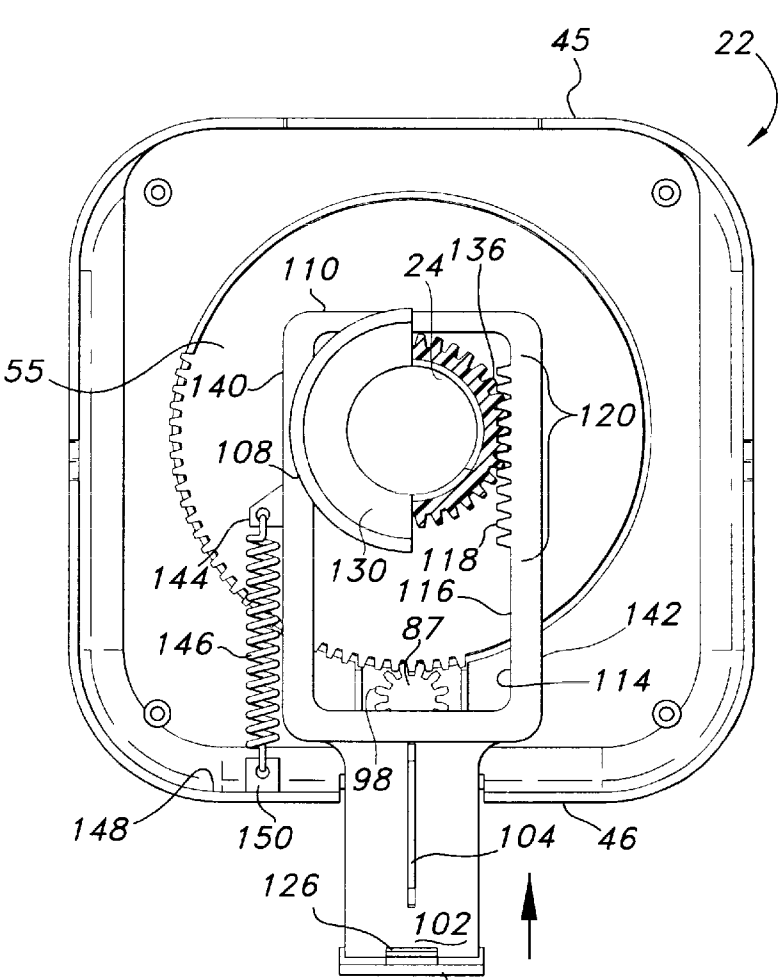
FIG. 21 is a top plan view of the dispensing platform and a partial sectional view of the pinion gear, showing the slide moved outward, partially away from the dispenser and the engagement of the slide with the pinion gear to open the iris diaphragm from its pre-set opening diameter to a relatively larger opening diameter within the range.
Figure 20:
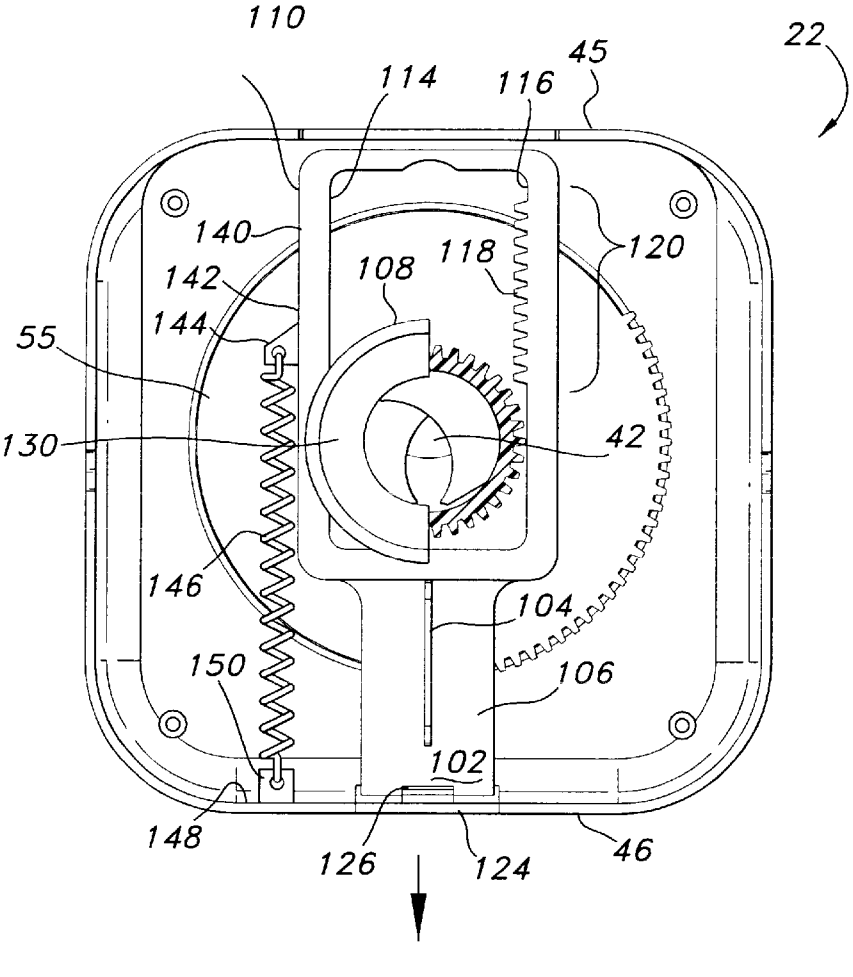
FIG. 20 is a top plan view of the dispensing platform and a partial sectional view of the pinion gear, showing disengagement of the rack gear teeth of the slide with the pinion gear, showing the pre-set opening diameter of the iris diaphragm mechanism.

When the handle 124 is moved slightly downward to disengage the locking tab 126 from the retention lip 128, as shown in FIG. 19B, the slide 102 is moved from its locked position to its unlocked position. As illustrated in FIGS. 20 and 21, when the handle 124 and a portion of the slide 102 is moved outwardly, away from the housing 38 of the dispenser 10, the slide 102, and the opening 42 in the iris diaphragm 40 are moved into a loading position. Movement of the slide 102 away from the dispenser 10 causes the gear rack teeth 118 of the slide 102 to engage the pinion gear teeth 136 of the pinion gear 108 thereby rotating the pinion gear 108. The cam gear 55, coupled to the pinion gear 108, also rotates causing movement of the iris blades 52, 53, 54 of the iris diaphragm 40 so that the diameter of the opening 42 therein is increased, desirably to about the diameter of the exit port 24, to allow an the sheet material 18 of a new centerflow roll 20 to be easily disposed through the exit port 24 by an operator. However, when the slide 102 is returned to its locked position in the dispenser 10, the rack gear teeth 118 are arranged on the portion 120 of the slide 102 so as to disengage the pinion gear teeth 136, as illustrated in FIGS. 16 and 20. Such disengagement permits the diameter of the opening 42 of the iris diaphragm 40 to be adjusted via the adjustment gear 87 as described previously. It will be understood that the slide 102 and the pinion gear 108 (slide assembly) are used only to increase the pre-adjusted diameter of the opening 42 of the iris diaphragm to facilitate loading sheet material 18 from a new centerflow roll 20.

It will be understood that the slide 102 is manually movable, relative to the dispenser 10, into an unlocked loading position as well as a locked dispensing position. However, as also illustrated in FIGS. 20 and 21, one side 140 of a perimeter 142 of the rectangular portion 110 of the slide 102 may optionally include a connection 144 having one end of a spring 146 coupled thereto, as illustrated in FIGS. 20–21. In this option, an inner surface 148 of the front wall 46 will include a similar connection 150 having an opposite end of the spring 146 coupled thereto. In this manner, the slide 102 will be spring biased, and, when unlocked, will move immediately into a loading position to facilitate loading the sheet material 18 unimpeded through the exit port 24.

Figure 4:
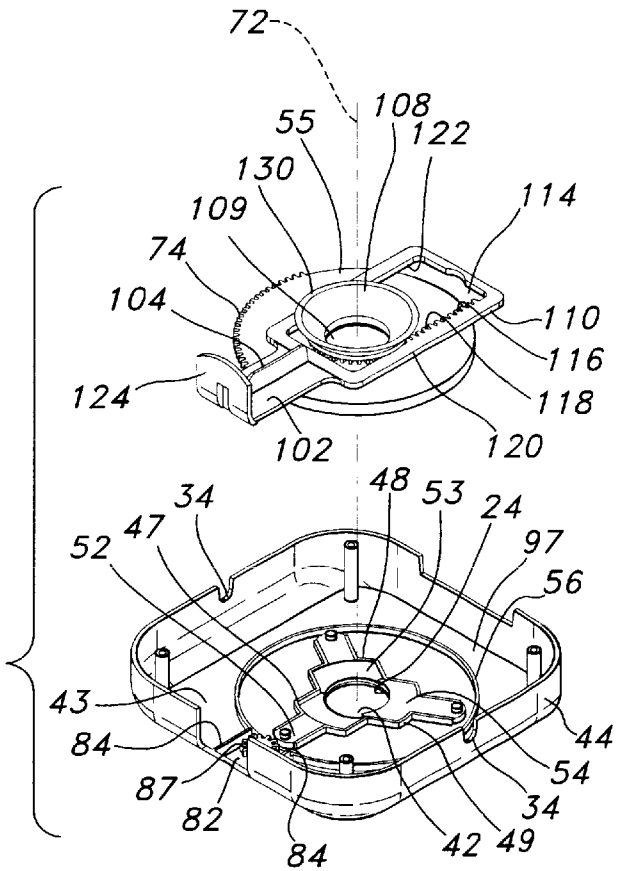
FIG. 4 is an exploded view of the dispensing platform, showing an opening formed by a plurality of iris blades over the exit port, the iris blades positioned to form a relatively large diameter of the opening within a range.
Figure 3:
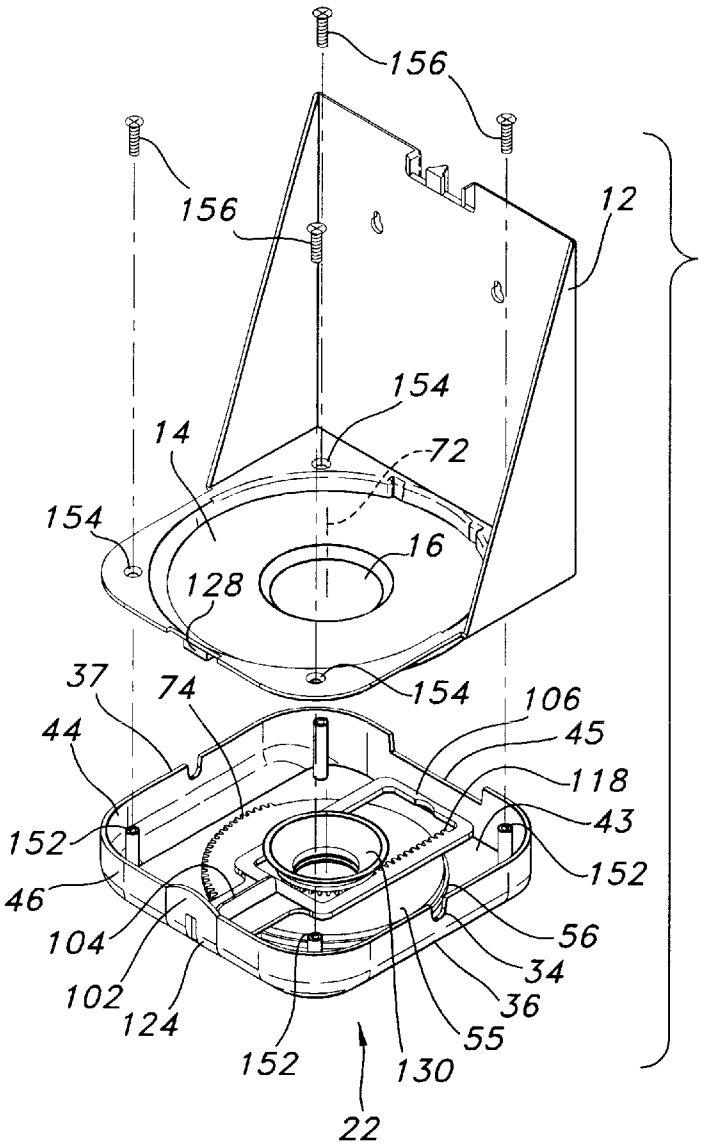
FIG. 3 is an exploded view of the mounting plate, roll platform, and the dispensing platform of the dispenser of FIGS. 1 and 2.
Figure 6:
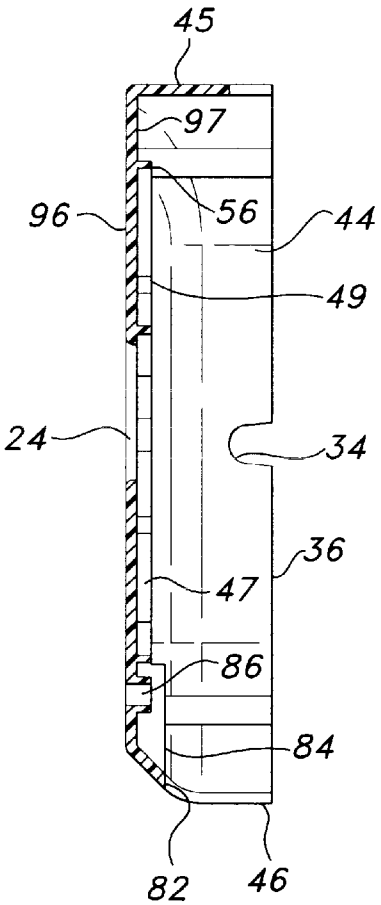
FIG. 6 is a sectional view of FIG. 5 taken along line 6—6.
Figure 5:
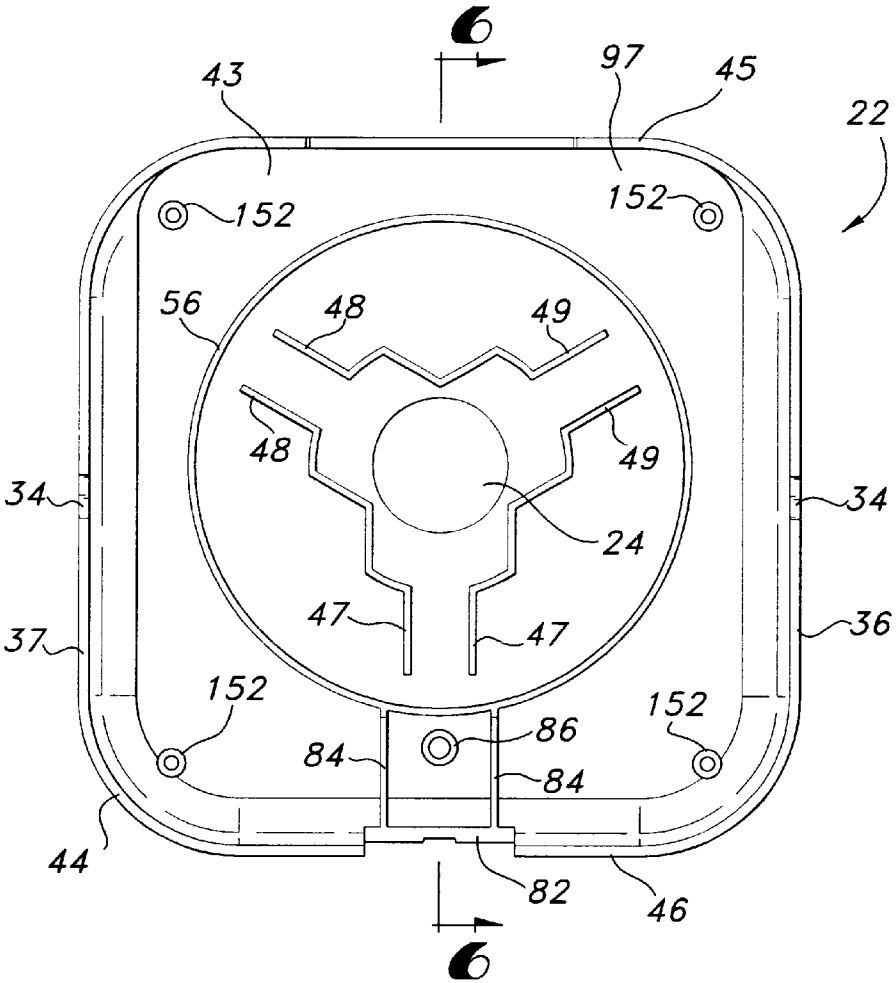
FIG. 5 is a top plan view of the dispensing platform.
Figure 8:
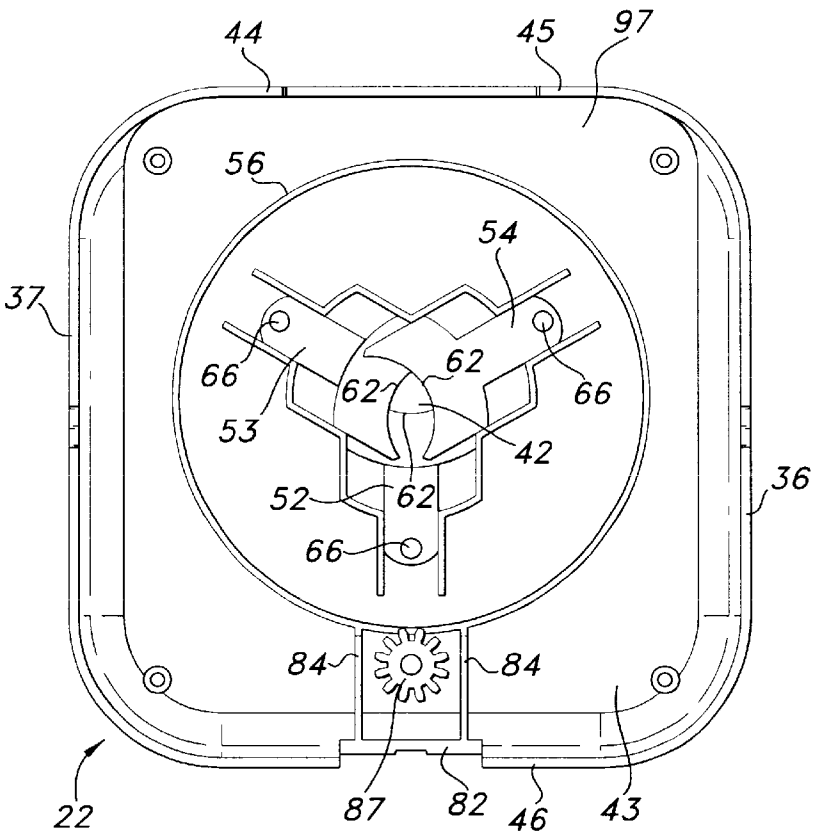
FIG. 8 is a top plan view of the dispensing platform showing the opening formed by the iris blades at a relatively smaller diameter within the range, as compared to FIG. 7.
Figure 7:
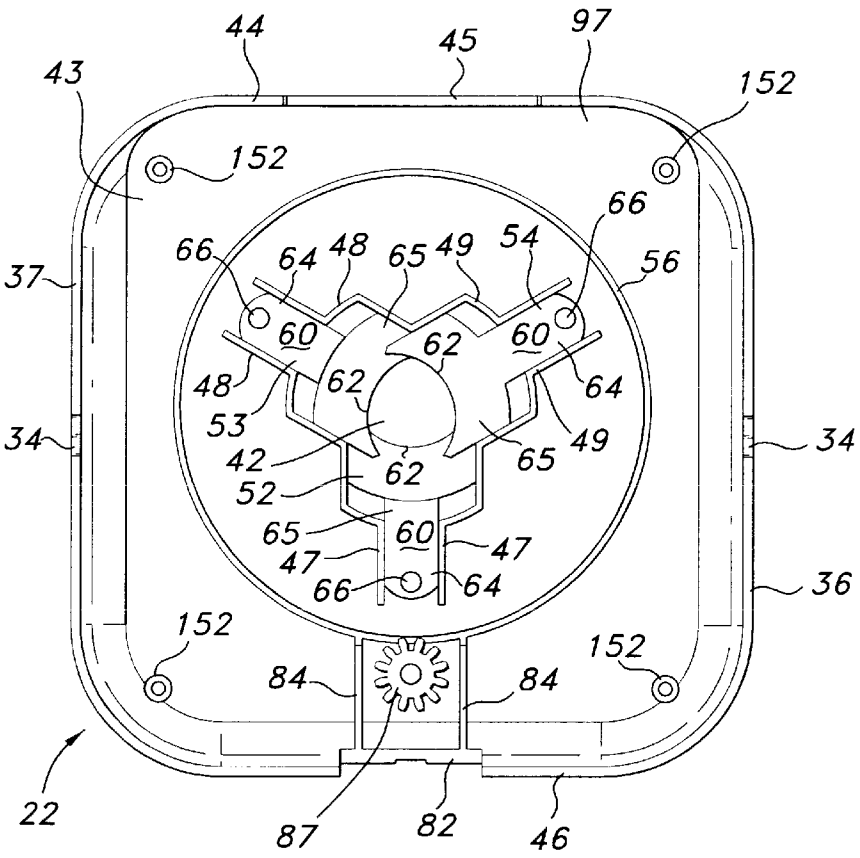
FIG. 7 is a top plan view of the dispensing platform showing the opening formed by the iris blades at about an intermediate diameter within the range.
Figure 9:
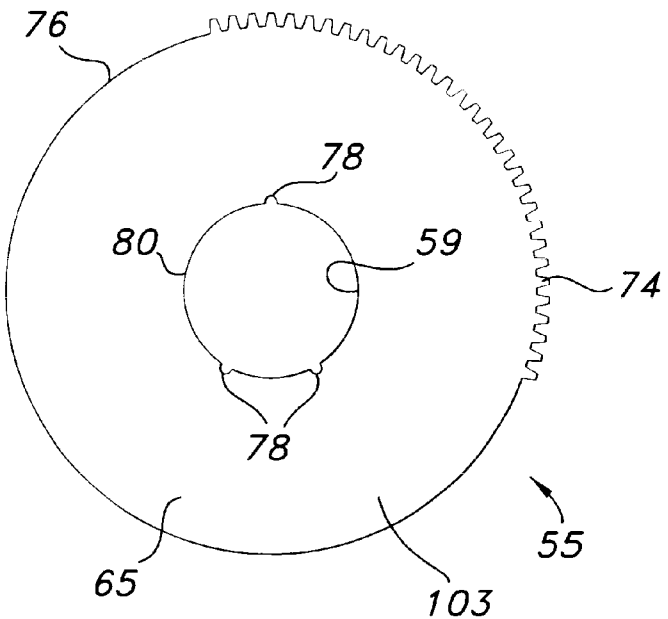
FIG. 9 is a top plan view of an upper surface of a cam gear.
Figure 10:
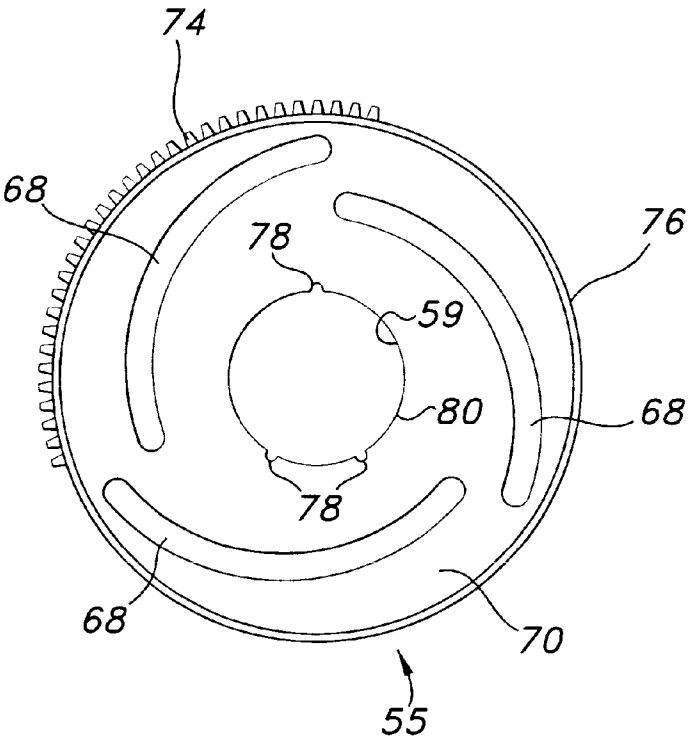
FIG. 10 is a top plan view of a lower surface of a cam gear showing the cam recesses.

As shown in FIGS. 2–4, the dispensing platform 122 has, positioned near its perimeter 44, a plurality of bosses 152. Each boss 152 has a threaded opening therein. The roll platform 14 has a plurality of apertures 154 formed therein, one of each of the plurality of apertures 154 aligning axially with one of each of the plurality of bosses 152. A plurality of fasteners, such as, but not by way of limitation, threaded screws 156, are also provided. One of each of the plurality of threaded screws 156 is positioned through each aligned aperture 154 and boss 152 combination to couple the dispensing platform 22 to the roll platform 14, thereby coupling the dispensing platform 22 to the housing 38 of the dispenser 10. It will be appreciated that the dispensing platform 22 may be coupled to the housing 38 by any apparatus and/or means known in the art.

While the dispensing platform 22 is shown and described in detail herein is, for purposes of illustration, shown as a separate platform coupled to the housing 38, it will be understood that the dispensing platform 38, may be formed integrally with one or more components of the housing 38. In addition, it will also be appreciated that the dispensing platform 22, along with the components shown and/or described herein associated with the dispensing platform 22 (i.e., those used for controlling the flow of sheet material 18 through the exit port 24), may be coupled to any dispenser having a housing. Further, it will be understood that the iris diaphragm 40 of the dispensing platform 22 and/or the exit port 24 may be offset in relation to the roll platform 14 to form a "Z" shape of the sheet material 18 as it flows from the roll platform 14 and out of the exit port 24, as disclosed in U.S. Pat. No. 6,145,782 to King et al., which is hereby incorporated by reference herein.

In a method of installing sheet material 18 into the dispenser 10, an operator accesses the roll platform 14 by removing the cover 25 of the dispenser 10. The operator unlocks the slide 102 and by gripping the handle 124 moves at portion of the slide 102 a distance outward, away from the dispenser 10. The slide 102 engages and rotates a pinion gear 108 engaged to a portion of the iris diaphragm 40, namely, the cam gear 55. The cam gear in turn is rotated in a direction to cause movement of each iris blade 52, 53, 54 away from the others so that the diameter of the opening 42 of the iris diaphragm 40, pre-adjusted for dispensing sheet material 18, is increased to a larger diameter to facilitate loading additional sheet material, thereby providing a loading position.

The operator disposes a centerflow roll 20 onto the roll platform 14, and pushes a leading edge of sheet material 18 through the opening 16 in the platform, through the opening 42 in the iris diaphragm 40, and through the exit port 24, to load the roll 20 and the sheet material 18. The referenced openings 16 and 42, and the exit port 24, cooperate to provide a channel for movement of sheet material 18 from the roll platform 14 to exit port 24. The slide 102 is then moved toward the dispenser 10. Upon such movement, the slide 102 again rotates the pinion gear 108 thereby rotating the cam gear 55 in an opposite direction, thereby moving each iris blade 52, 53, 54 toward the others to decrease the diameter of the opening 42 of the iris diaphragm 40 to its pre-adjusted diameter, to again provide the dispensing position.

The operator adjusts the iris diaphragm 40 via the adjustment gear 87 which operatively engages the iris diaphragm 40 for the particular centerflow roll product and its characteristics via the cam gear 55 so that the diameter of the opening 42 of the iris diaphragm 40 is incrementally adjusted to a diameter or size which permits an effective number of sheet material(s) 18 to be dispensed through the opening 42 of the iris diaphragm 40 and the exit port 24 such that the sheet material 18 is neither excessively dispensed nor under dispensed. It will be understood that the diameter of the opening 42 of the iris diaphragm 40 remains in its adjusted dispensing position, and it is altered only by the movement of the slide 102 away from the dispenser 10 in a loading position until the diameter of the opening 42 of the iris diaphragm 40 is re-adjusted to a different dispensing position by an operator via the adjustment gear 87.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material, the dispenser comprising:

a housing formed to include at least an exit port and configured to support sheet material therein; and an iris diaphragm including at least three iris blades positioned on the housing and supported for movement to form an opening having a diameter incrementally adjustable within a range, the iris diaphragm configured to be adjusted to any one of a plurality of opening diameters within the range, the iris diaphragm configured to permit the diameter of the opening to be adjusted for each product-type of sheet material positioned in the dispenser to provide controlled dispensing of the sheet material through the exit port.

2. The dispenser of claim 1, wherein each iris blade is positioned between support ribs on the housing and each iris blade is operably coupled to a cam gear for movement.

3. The dispenser of claim 2, wherein the range is at least partially defined by the limitation of movement of each iris blade within guide ribs supported by the housing.

4. The dispenser of claim 2, wherein each iris blade is coupled to the cam gear such that rotation of the cam gear in one direction moves each iris blade toward an axis of the iris diaphragm to decrease the diameter of the opening and rotation of the cam gear in an opposite direction moves each iris blade away from the axis of the iris diaphragm to increase the diameter of the opening.

5. The dispenser of claim 4, wherein the cam gear is engaged to an adjustment gear such that rotation of the adjustment gear causes rotation of the cam gear and movement of each iris blade.

6. The dispenser of claim 1 further comprising an adjustment gear engaged to a portion of the iris diaphragm.

7. The dispenser of claim 6, wherein rotation of the adjustment gear causes rotation of at least the portion of the iris diaphragm and movement of the iris blades such that rotation of the adjustment gear in one direction moves each iris blade toward an axis of the iris diaphragm to decrease the diameter of the opening and rotation of the cam gear in an opposite direction moves each iris blade away from the axis of the iris diaphragm to increase the diameter of the opening.

8. The dispenser of claim 1 further comprising a slide assembly including a slide and a pinion gear operably coupled to a portion of the iris diaphragm, the slide movable at least partially away from the dispenser for increasing the diameter of the opening formed by the iris diaphragm to provide a loading position, the slide movable toward the dispenser to provide a locked position relative to the dispenser and decreasing the diameter of the opening of the iris diaphragm to its pre-adjusted diameter to provide a dispensing position.

9. The dispenser of claim 8 wherein the slide includes a spring coupled to both the slide and the lower housing, the spring biased to move the slide at least partially away from the dispenser when the slide is unlocked from the dispenser thereby moving the iris diaphragm into a loading position.

10. The dispenser of claim 8, wherein the pinion gear engages the slide and a cam gear and the cam gear is coupled to the iris blades such that movement of the slide results in rotation of the pinion gear and the cam gear thereby causing movement of the iris blades.

11. The dispenser of claim 10, wherein when the slide is moved away from the dispenser, the slide rotates both the pinion gear and the cam gear to move the iris blades away from an axis of the iris diaphragm.

12. The dispenser of claim 10, wherein when the slide is moved toward the dispenser, the slide rotates both the pinion gear and the cam gear to move the iris blades toward an axis of the iris diaphragm.

13. The dispenser of claim 1, wherein the opening formed by the iris diaphragm is non-elliptical in shape.

14. The dispenser of claim 1, wherein the iris diaphragm is positioned between the sheet material and the exit port.

15. The dispenser of claim 1, wherein the increments range from about 0.5 mm to about 8.0 cms.

16. The dispenser of claim 15, wherein the increments range from about 0.5 cm to about 2.5 cms.

17. The dispenser of claim 16, wherein the increments range from about 0.5 cm to about 0.75 cm.

18. The dispenser of claim 1, wherein a measurement of the diameter of the opening formed by the iris blades is more than 50% of a measured length of each portion of each iris blade next to the opening at any diameter of the opening.

19. The dispenser of claim 18, wherein a measurement of the diameter of the opening formed by the iris blades is more than 70% of a measured length of each portion of each iris blade next to the opening at any diameter of the opening.

20. The dispenser of claim 1, wherein the iris diaphragm comprises curved iris blades.

21. An apparatus adapted for use with a dispenser housing for sheet material, the apparatus configured to cooper ate with an opening formed in the dispenser housing to control the flow of sheet material disposed in the dispenser housing and extending through the opening therein, the apparatus comprising:

a platform formed to include an exit port; and an iris diaphragm including a plurality of iris blades positioned on the platform and supported for movement to form an opening having a diameter increment ally adjustable within a range, the iris diaphragm configured to be adjusted to any one of a plurality of opening diameters within the range, the iris diaphragm configured to permit the diameter of the opening formed therein to be adjusted for each product-type of sheet material positioned in a dispenser housing to provide controlled dispensing of the sheet material from the apparatus and through the exit port.

22. The apparatus of claim 21, wherein each iris blade is positioned between support ribs on the platform and each iris blade is operably coupled to a cam gear for movement thereof such that rotation of the cam gear in one direction moves each iris blade toward an axis of the iris diaphragm to decrease the diameter of the opening and rotation of the cam gear in an opposite direction moves each iris blade away from the axis of the iris diaphragm to increase the diameter of the opening.

23. The apparatus of claim 22, wherein each iris blade is positioned between support ribs on the platform and each iris blade is operably coupled to a cam gear for movement.

24. The apparatus of claim 22, wherein the cam gear is engaged to an adjustment gear such that rotation of the adjustment gear causes rotation of the cam gear and movement of each iris blade.

25. The apparatus of claim 21 further comprising an adjustment gear engaged to a portion of the iris diaphragm, wherein rotation of the adjustment gear in one direction moves each iris blade toward an axis of the iris diaphragm to decrease the diameter of the opening and rotation of the adjustment gear in an opposite direction moves each iris blade away from the axis of the iris diaphragm to increase the diameter of the opening.

26. The apparatus of claim 21 further comprising a slide assembly including a slide and a pinion gear coupled to a portion of the iris diaphragm, the slide movable at least partially away from the dispenser housing for increasing the diameter of the opening formed by the iris diaphragm to provide a loading position, the slide movable toward the dispenser to provide a locked position relative to the dispenser housing and decreasing the diameter of the opening of the iris diaphragm to its pre-adjusted diameter to provide a dispensing position.

27. The apparatus of claim 26, wherein the pinion gear is engaged to the slide and a cam gear such that movement of the slide results in rotation of the pinion gear and the cam gear resulting in movement of the iris blades coupled to the cam gear, and wherein when the slide is moved away from the dispenser housing, the slide rotates the pinion gear and the cam gear to move each iris blade away from an axis of the iris diaphragm, and wherein when the slide is moved toward the dispenser housing, the slide rotates the pinion gear and the cam gear to move each iris blade toward the axis of the iris diaphragm.

28. The apparatus of claim 21, wherein a measurement of the diameter of the opening formed by the iris blades is more than 60% of a measured length of each portion of each iris blade next to the opening at any diameter of the opening.

29. The apparatus of claim 21, wherein the iris diaphragm comprises curved iris blades.

30. The dispenser of claim 21, wherein the increments range from about 0.5 mm to about 8.0 cms.

31. The dispenser of claim 30, wherein the increments range from about 0.5 cm to about 2.5 cms.

32. The dispenser of claim 31, wherein the increments range from about 0.5 cm to about 0.75 cm.

33. A method of installing a sheet material product into a dispenser, the method comprising:

accessing a platform provided in a housing of a dispenser having an exit port, the housing including an iris diaphragm having an opening pre-adjusted to dispense an effective number of sheet material products through the opening and the exit port;

moving a portion of a slide assembly positioned in the dispenser at least partially away from the dispenser, the slide assembly operatively engaged to at least a portion of the iris diaphragm such that movement of the slide assembly moves the iris diaphragm thereby increasing the diameter of the opening to provide a loading position adjacent the exit port;

disposing a sheet material product onto the platform, the platform formed to include an opening positioned at least partially below the product, the opening in communication with the opening formed by the iris diaphragm and the exit port forming a channel for the movement of sheet material therethrough;

pushing a leading edge of the sheet material through the channel and the exit port; and moving the portion of the slide assembly toward the dispenser, the slide assembly moving the iris diaphragm such that the diameter of the opening formed thereby is reduced to its pre-adjusted diameter providing a dispensing position.

34. The method of claim 33, wherein the step of accessing a platform includes the step of moving a cover away from at least a portion of the housing.

35. The method of claim 33, wherein the step of moving a portion of a slide assembly positioned in the dispenser at least partially away from the dispenser includes the step of unlocking a portion of the slide assembly from the dispenser.

36. The method of claim 33, wherein the step of moving the portion of the slide assembly toward the dispenser includes the step of locking a portion of the slide assembly to the dispenser.

37. A method of adjusting sheet material flow from a dispenser, the method comprising:

providing a dispenser housing configured to support sheet material therein, the dispenser housing having an iris diaphragm and an exit port; and incrementally adjusting the diameter of an opening formed by the iris diaphragm such that the opening is sized to permit an effective amount of sheet material to be dispensed through the opening and the exit port so that the sheet material is neither excessively dispensed nor under dispensed.

38. The method of claim 37, wherein the step of incrementally adjusting the diameter of the opening formed by the iris diaphragm includes the step of accessing a portion of an adjustment gear engaged with the iris diaphragm from an outside surface of the dispenser and moving the portion of the adjustment gear so that the diameter of the opening of the iris diaphragm is altered.

39. A dispenser adapted to dispense sheet material, the dispenser comprising:

a housing including a platform and having an exit port therein, the housing configured to support sheet material therein; and means positioned adjacent the housing for controlling the movement of sheet material disposed in the housing through the exit port, the controlling means including an iris diaphragm.

40. The dispenser of claim 39, wherein the controlling means further comprises an adjustment gear engaged to a portion of the iris diaphragm and the iris diaphragm includes a plurality of iris blades, wherein rotation of the adjustment gear in one direction incrementally moves each iris blade toward an axis of the iris diaphragm to decrease a diameter of an opening formed thereby and rotation of the adjustment gear in an opposite direction incrementally moves each iris blade away from the axis of the iris diaphragm to increase the diameter of the opening formed thereby.

41. The dispenser of claim 40, wherein the iris diaphragm comprises curved iris blades.

42. The dispenser of claim 40, wherein each iris blade is positioned between support ribs on the platform and each iris blade is operably coupled to a cam gear for movement thereof such that rotation of the cam gear in one direction moves each iris blade toward an axis of the iris diaphragm and rotation of the cam gear in an opposite direction moves each iris blade away from the axis of the iris diaphragm.

43. The dispenser of claim 39 further comprising a slide assembly including a slide and a pinion gear operably coupled to a portion of the iris diaphragm, the slide movable at least partially away from the dispenser to increasing a diameter of an opening formed by the iris diaphragm to provide a loading position, the slide movable from a position at least partially away from the dispenser toward the dispenser to provide a locked position relative to the dispenser and to decrease the diameter of the opening of the iris diaphragm to its pre-adjusted diameter, thereby providing a dispensing position.

44. The dispenser of claim 43, wherein the pinion gear is engaged to the slide and a cam gear such that movement of the slide results in rotation of the pinion gear and the cam gear resulting in movement of a plurality of iris blades operably coupled to the cam gear, and wherein when the slide is moved away from the dispenser, the slide rotates both the pinion gear and the cam gear to move each iris blade away from an axis of the iris diaphragm, and wherein when the slide is moved toward the dispenser, the slide rotates both the pinion gear and the cam gear to move each iris blade toward the axis of the iris diaphragm.

45. The dispenser of claim 39, wherein the iris diaphragm includes iris blades which form an opening having a diameter that is adjustable in increments, and wherein a measurement of the diameter of the opening formed by the iris blades is more than 70% of a measured length of each portion of each iris blade next to the opening at any diameter of the opening.

46. The dispenser of claim 45, wherein the increments range from about 0.5 mm to about 8.0 cms.

47. The dispenser of claim 46, wherein the increments range from about 0.5 cm to about 2.5 cms.

48. The dispenser of claim 47, wherein the increments range from about 0.5 cms to about 2.0 cms.

* * * * *